United States Patent [19]

Leorat

[11] 4,349,320

[45] Sep. 14, 1982

[54] PISTON COMPRESSOR DERIVED FROM A RECIPROCATING THERMAL ENGINE

[75] Inventor: François J. Leorat, Versailles, France

[73] Assignee: Regie Nationale des Usines Renault, Boulogne-Billancourt, France

[21] Appl. No.: 140,197

[22] PCT Filed: Oct. 6, 1978

[86] PCT No.: PCT/FR78/00029

§ 371 Date: Jun. 12, 1979

§ 102(e) Date: Jun. 12, 1979

[87] PCT Pub. No.: WO79/00199

PCT Pub. Date: Apr. 19, 1979

[30] Foreign Application Priority Data

Oct. 12, 1977 [FR] France ..... 77 30663

[51] Int. Cl.[3] ..... F04B 41/04

[52] U.S. Cl. ..... 417/237; 417/902

[58] Field of Search ..... 417/237, 901, 902, 360

[56] References Cited

U.S. PATENT DOCUMENTS 1,800,631 4/1931 Hewitt et al. ..... 417/237

1,804,873 5/1931 Hoffman ..... 417/237

*Primary Examiner*—Richard E. Gluck

*Attorney, Agent, or Firm*—Stevens, Davis, Miller & Mosher

[57] ABSTRACT

A compressor of the piston-type enclosed in a sealed housing. The specific cylinder head of the compressor is completed by an assembly of mass-produced internal combustion engine parts and the compressor is driven through the wall of the housing from an external motor.

5 Claims, 5 Drawing Figures

PISTON COMPRESSOR DERIVED FROM A RECIPROCATING THERMAL ENGINE

The present invention relates to a compressor construction obtained by converting a reciprocating thermal engine, notably for a refrigerating fluid compressor of the open, semi-sealed or sealed type. Such conversion is well known in the art and may be made in several ways such as those presented, for instance, in U.S. Pat. Nos. 1,800,631 and 1,804,873.

This invention is applicable to most reciprocating engines, whether of the oil or petrol cycle type, water-cooled or air-cooled, with or without liners, provided that they originally include a detachable cylinder head.

It is known that as far as low-power, single- or multi-cylindered piston compressors are concerned, whatever may be the type thereof (open, semi-sealed or sealed), production rates are extremely high, for these apparatus correspond to wide-spread applications in household appliances such as refrigerators, small-scale air-conditioning, automobile air-conditioning, etc. In contrast thereto, when considering the power ratings corresponding to so-called industrial refrigeration or central-station air-conditioning, for example, the production rates seldom exceed a few thousands, or a few tens, of units per year, compared with several million units for low-power units. Since on the other hand the demand is divided among a relatively large number of manufacturers, it is obvious that notably for the construction of medium or high-power piston compressors, most frequently of the open type, the production series are relatively small if not very small. This accounts to a large extent for the high cost of this equipment, and this high price is also justified by the high-grade metal parts (free of any porosity or cracks, perfectly homogeneous) required for the crankcases and closing members in order to provide the necessary fluid-tightness and bursting resistance.

Now, there is an obvious and pronounced "morphological" analogy between reciprocating thermal engines and compressors, and another obvious fact is the considerable difference, in favour of thermal engines, between the production costs of these two types of machines, this difference being due essentially to the consequence of mass production. The aim of the present invention is to carry out the conversion of a reciprocating thermal engine into a compressor, notably a refrigeration one, in order to take advantage of the low-cost of reciprocating thermal engines as a consequence of the mass production of the main component elements thereof, while adhering strictly to the specific requirements of compressors. This invention consists essentially, while maintaining among the component elements of a reciprocating thermal engine those (notably the most expensive ones: cylinder-crankcase, movable device, oil pump) usable directly in the compressor version, in enclosing the crankcase-cylinder unit in a fluid-tight welded steel and pressure-withstanding container, and providing the necessary functional connections between the crankcase-cylinder unit and the container (compressor drive, operating-fluid suction and delivery fittings, etc).

Thus, this invention is directed in general to a piston-type compressor structure enclosed in a fluid-tight housing, characterized in that its specific compressor cylinder-head is completed by a set of mass-produced internal-combustion engine parts, the compressor being driven through the fluid-tight housing from an external motor.

The compressor is generally secured to the cover of the fluid-tight housing by means of its cylinder-head, either through a connecting member secured to one end of the cylinder-head and by a connecting member provided at the same end of the cylinder block and bearing on the support of the compressor driving members through the fluid-tight housing, or the cover itself consists of the cylinder-head provided with adequate flanges and covers, the other component elements thereof being fastened to said cylinder-head within the fluid-tight housing where they are coupled to the compressor drive means extending through the housing.

Complementary fastening means secured to the various supports normally provided on the engine for mounting accessories unnecessary for the compressor connect the latter to fastening points of the housing, notably in the case of the most important patterns.

The suction fitting will be carried directly by the housing, the compressor sucking directly from the latter or through an external inlet connected directly to the cylinder-head while constituting at the same time a securing member to the housing.

The drive is carried out through a flexible coupling housed within the housing, the coupling being driven by a relatively short intermediate shaft journalled in bearings and provided with sealing means.

The flexible coupling, preferably of the type having a pair of coaxial pinions interconnected by a chain, will be connected to the intermediate shaft by means of a sliding-spline joint, notably in patterns suspended from the cover-forming cylinder-head, thus facilitating the assembling operation.

Examples of embodiment of the invention will now be described with reference to the accompanying drawings.

Figure 1:
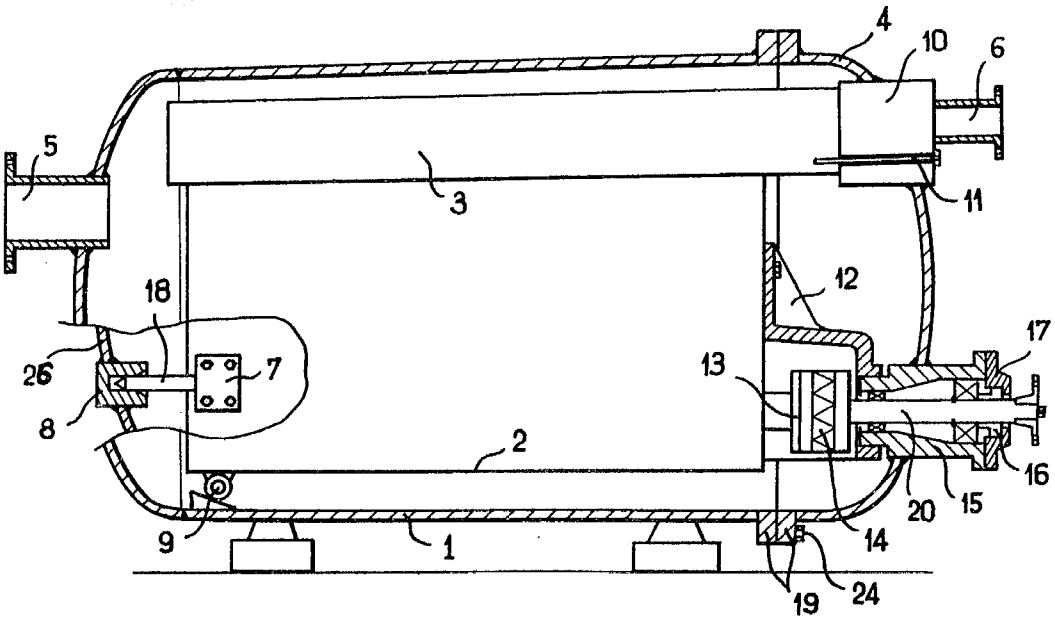
FIG. 1 shows a preferred embodiment of the invention.

In the exemplary of embodiment illustrated in FIG. 1, the crankcase-cylinder unit (2) has been removed from the accessories required for its operation as a reciprocating thermal engine (such as fuel system, timing gear, ignition system, cooling system, flywheel, etc) and is provided with a suitable cylinder-head (3) of the automatic valve type, for example for a liquid refrigerant. The carter/cylinder-head assembly is introduced into a housing (1) made of thick steel plate assembled by welding, the cover (4) of which insures the holding of the carter/cylinder-head assembly in position as hereinafter described: a block (10) welded to the cover (4) is fastened by means of studs (11) to the front end of the cylinder-head (3). On the other hand, the block (10) allows the passage of the delivery pipe (6). A bearing block (15) having its axis accurately aligned with the axis of the crankshaft (13) is welded to the cover (4). A connecting member (12) bolted to the cylinder block (2) bears on a journal portion of bearing block (15) and absorbs the reaction torque during the compressor operation. The cover (4) is itself rigidly fastened to the compressor housing (1) by means of bolts (24) through registering flanges (19) welded to (1) and (4). The compressor is driven by means of a flexible coupling (14)

secured to the securing flange or boss of crankshaft (13) in lieu and place of the conventional flywheel. The coupling (14) drives an intermediate shaft (20) provided with a shaft packing (16) held in position by the cover (17). The coupling (14) may advantageously consist of a pair of coaxial pinions interconnected by a Brampton chain.

If the basic engine is of a type such that the overhang of the above-described arrangement is excessive (for instance in the case of a six-cylindered in-line engine), support arms (18) may be mounted on the lateral engine-supporting brackets (7). The arms, consisting of cylindrical rods having a tapered end, engage circular bores with bevelled inlets formed in blocks (8) welded to the bottom (26) of housing (1), thus eliminating the overhang. If necessary, a skid or roller (9) may be provided for facilitating the introduction and proper positioning of the crankshaft and cylinder-block assembly into the housing (1).

Figure 2:
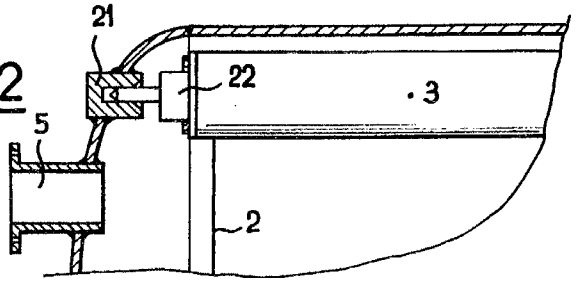
FIGS. 2 and 3 illustrate variants of the embodiment shown in FIG. 1.
Figure 3:
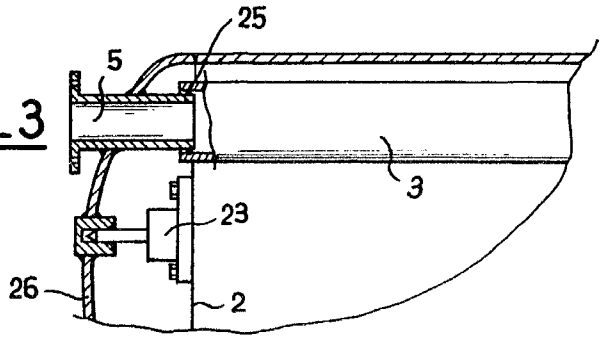

When assuming that brackets (7) were not provided or are in an awkward position, the side arms (18) may be secured as shown at (22) to the rear end of the cylinder-head (3) (FIG. 2), or in another position (23) on the cylinder-block (in lieu and place of the water pump, or of the timing gear case, or of any other engine accessory mounted on this portion of the engine), as shown in FIG. 3.

If the operating fluid can be sucked without any inconvenience into the housing (1), the inlet pipe (5) may be welded to any suitable location to the housing (1), for example to the bottom (26) (FIGS. 1 and 2). If not, the pipe (5) is then necessarily welded to the bottom (26) so that its inner end projects into a suitable aperture in the cylinder-head (3), the tightness being obtained by means of a seal (25) (FIG. 3).

Figure 4:
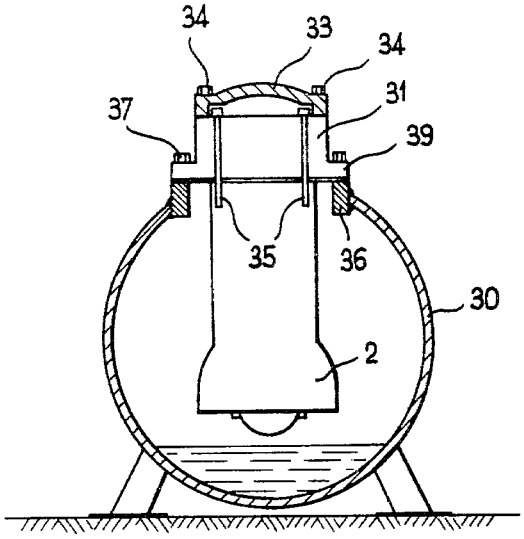
FIGS. 4 and 5 show an alternative embodiment of the invention.
Figure 5:
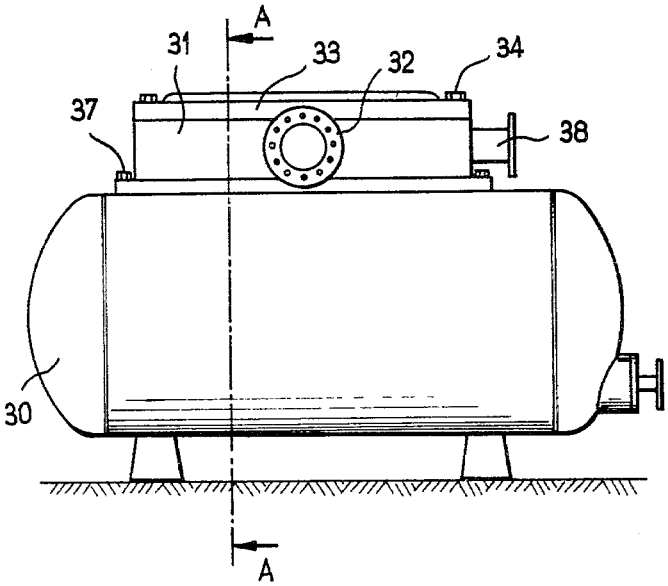

For compressor applications requiring a ready access to the automatic valves, the modified embodiment illustrated in FIGS. 4 and 5 will be preferred. In this variant, the cylindrical housing (30) comprises at its upper portion a rectangular aperture to which a frame made of relatively thick sections (36) is welded. The dimensions of this frame (36) are such that the cylinder-block (2), after the coupling (14) thereof has been previously fastened to the flywheel flange of crankshaft (13), can be lowered through this frame into the housing (30). The cylinder-head (31), rigidly fastened by means of bolts (35) to the cylinder-block (2), bears with its lower surface through its flange (39) on the frame (36) and is secured thereto by means of bolts (37). The cylinder-head (31) is closed by a top cover (33) fastened by bolts (34) which allows direct access to the valve means. The structure of the coupling (14) is similar to that described with reference to the variant shown in FIG. 1, except that:

the connecting bracket (12) can be dispensed with, the intermediate shaft (20) drives the shaft (14) through sliding splines, so that the shaft (20) can be moved to its operative position by sliding when the cylinder-block (2) is positioned in the housing (30), after previously fastening the coupling (14) to the crankshaft flange (13). In this embodiment, the inlet pipe (32) and delivery pipe (38) are most conveniently disposed on the side faces of the cylinder-head, as in the example shown in FIG. 5.

I claim:

1. A piston compressor of the sealed housing type, comprising a specific compressor cylinder-head completed by an assembly of parts for a mass-production internal combustion engine including a cylinder-block and driven through the sealed housing by an external motor by drive means passing through a support member, said compressor being adapted to fit with a cover of said sealed housing through its cylinder-head, wherein the compressor is secured to said cover by means of a first coupling member fixed on said cylinder-head and by a second coupling member fixed on said cylinder-block and bearing on said support of said drive means of the compressor through said cover of said sealed housing.

2. The compressor of claim 1, wherein said cover consists of a cylinder-head provided with suitable flanges and covers, the other members of the compressor being fastened to said cylinder-head within said sealed housing and coupled to drive means passing through said sealed housing.

3. The compressor of claim 1, wherein additional fastening means, which are secured to bosses provided on the cylinder-block for mounting internal combustion engine accessories not used for the compressor, are provided for interconnecting the latter to fastening points on the sealed housing.

4. The compressor of claim 1, wherein suction takes place through an external pipe connected directly to the cylinder-head and adapted to constitute a securing member to the sealed housing.

5. The compressor of claim 1, wherein the drive means comprise a flexible coupling disposed within the housing, the coupling being driven through a short intermediate shaft journalled in bearings and provided with sealing means.

* * * * *